US005321961A

United States Patent [19]

Barberi

[11] Patent Number: 5,321,961

[45] Date of Patent: Jun. 21, 1994

[54] SECURITY DOOR FOR COIN OPERATED MACHINE

[76] Inventor: Louis J. Barberi, 505 N. Smith St., Unit 110, Corona, Calif. 91720

[21] Appl. No.: 30,597

[22] Filed: Mar. 11, 1993

[51] Int. Cl.[5] ..... E05B 67/38; G07F 9/06

[52] U.S. Cl. ..... 70/56; 70/159; 70/417; 70/DIG. 41; 194/350

[58] Field of Search ..... 70/2, 54–56, 70/158–162, 416–418, DIG. 41, DIG. 72; 292/281; 109/49.5; 194/350

[56] References Cited

U.S. PATENT DOCUMENTS

| | | | |
|---|---|---|---|
| 160,723 | 3/1875 | Smith et al. | 292/281 |
| 1,813,240 | 7/1931 | Joseph | 292/281 |
| 1,955,462 | 4/1934 | Kaufman | 70/417 |
| 4,286,814 | 9/1981 | Harrington et al. | 70/55 X |
| 4,418,551 | 12/1983 | Kochackis | 70/54 X |
| 4,784,252 | 11/1988 | Davis | 194/350 |
| 4,953,683 | 9/1990 | Eisermann | 194/350 X |

*Primary Examiner*—Lloyd A. Gall
*Attorney, Agent, or Firm*—John E. Vanderburgh

[57] ABSTRACT

A security device for coin operated machines comprises a closure adapted to overlie the portion of a coin operated machine containing the coin return slot and the coin box. The closure is hingedly affixed to the case of the machine and is formed from a sheet of material having a composition and thickness to resist bending of the closure by prying. Openings are provided in the closure for access to the coin insert slots and coin return ports of the machine. A raised rib formed on the case or on the inner face of the closure surrounds the area of surface of the case where the coin box and coin return ports are located, The rib is disposed between the case and the closure to prevent insertion of a prying tool between the closure and the case. A strap is disposed on the outer face of the closure so as to cover approximately the upper half of the opening, In addition the strap is offset from the surface of the case so that sufficient access is provided to the coin return slot to retrieve returned coins but insufficient space is available to manipulate the fingers for coin flipping. A lock housing overlies an opening in the closure for receiving a staple and at least the shackle of a lock for securing the closure to the case of the machine.

8 Claims, 2 Drawing Sheets

SECURITY DOOR FOR COIN OPERATED MACHINE

FIELD OF THE INVENTION

The invention relates to security devices and more particularly to security doors for installation on coin operated machines and the like.

BACKGROUND OF THE INVENTION

Coin operated machines have long been the target for various acts of theft and vandalism; the object being to either obtain the coins from the machine or to cause the machine to operate without the necessity of inserting a coin. With the advent of arcades and similar amusement locations where coin operated games are located, forced entry into the coin box of the machine has resulted in substantial losses to the arcade operators. In addition to forced entry, losses are also incurred as a result of "coin-flipping" which is a procedure involving inserting a finger in the coin return slot of the machine and propelling or flipping a coin into the slot with sufficient force to trip the operating switch causing the machine to operate as though a coin had been inserted in the coin insert slot. In this fashion a player can operate the machine without inserting coins. This type of loss has been difficult to prevent and, in the case of arcade game machines, can occur for substantial periods without the operator or vendor being aware of the loss in revenue due to free play.

Various devices have been proposed for securing areas subject to forced entry such as, for example, closures for buildings, the rear doors of a trailer of a tractor-trailer rig and the like.

In U.S. Pat. No. 4,269,048 a door locking system for securing adjacent doors having a common closure line is shown consisting of a locking bar affixed at one end to one door and extending across the common closure line to the second door. The locking bar is secured by a locking pin affixed to the second door and pin cover is detachably locked over an extending end of the locking pin when the locking bar is in its securing position.

U.S. Pat. No. 3,806,179 discloses a bar lock which extends across a door from a hinge to an eye bolt on the door frame. In this fashion the locking bar ties the door to the frame so that the bolt of the door lock cannot be separated from the door jamb by prying on the door frame.

Although these devices may be effective in preventing the forcible opening of a closure, they are not particularly suited for preventing theft and vandalism of coin operated machines, especially video game machines encountered in arcades.

SUMMARY OF THE INVENTION

The invention provides a security device for coin operated machines that is designed to prevent forcible entry into the coin box and to prevent tampering with the operation of the machine. In accordance with the invention the security device comprises a closure adapted to overlie the portion of a coin operated machine containing the coin return ports and the coin box. The closure is hingedly affixed to the case of the machine and is formed from a sheet of material having a composition and thickness to resist bending of the closure by prying. Openings are provided in the closure for access to the coin insert slots and coin return ports of the machine. The front face of many coin operated machines is provided with a bead or raised rib which surrounds the coin insert slot, the coin return slot and the general area of the coin box. The closure is configured to fit in the area enclosed by the rib so that a tool, such as a screw driver or pry bar, cannot be inserted between the closure and the machine case. In cases where the machine case does not have such a bead, a raised rib is formed about the periphery of the closure to prevent insertion of a prying tool between the closure and the machine case. A strap extends across the opening in the closure overlying the coin return slot. The width of the strap is narrower than the opening and the strap is positioned on the closure so as to cover approximately the upper half of the opening. In addition the strap is offset from the surface of the case so that sufficient access is provided to the coin return slot to retrieve returned coins but insufficient space is available to manipulate the fingers for coin flipping. A lock housing overlies an opening in the closure for receiving an eyebolt and at least the shackle of a lock for securing the closure to the case of the machine and for protecting the lock.

The invention will be more fully understood from the following detailed description taken in conjunction with the accompanying drawings which form an integral part thereof.

DESCRIPTION OF THE PREFERRED EMBODIMENT

Figure 1:
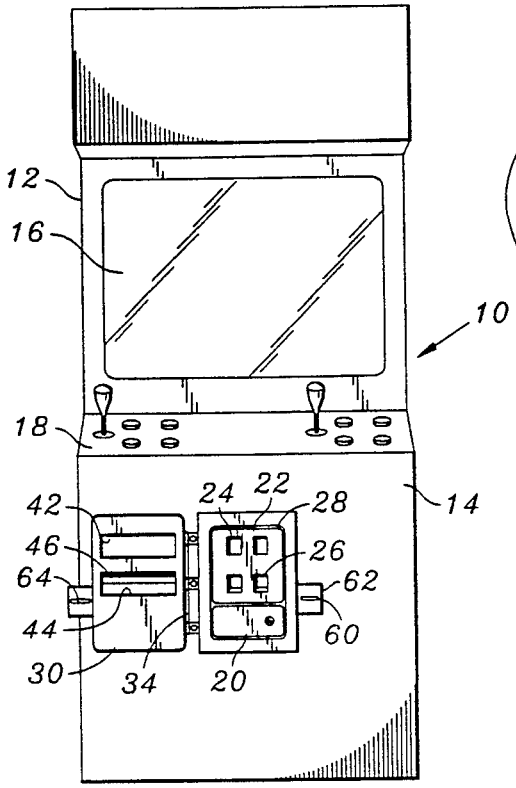
FIG. 1 is a front view of a coin operated video game machine showing the security device of the present invention affixed thereto.

Referring to FIG. 1 there is illustrated a coin operated video game machine, shown generally as 10, such as would be typically found in an arcade. The machine 10 includes a hollow case 12 having a front face 14 adapted for carrying a video display 16 and a control panel 18 including the necessary controls for operating the machine 10 during game play. The interior of the case 12 receives the circuitry (not shown) for the video display 16 and programmed electronics for the game. The lower portion of the interior of the case 12 carries a coin box 20 which is removably locked in the front face 14 of the case 12. A plate 22 carrying coin insert slots 24 is located above the coin box 20. In the embodiment illustrated the coin insert slots 24 are illuminated, as at 24', to indicate when a coin has been inserted in the slot. Immediately below are located coin return ports 26. The portion of the front face 14 of the case 12 surrounding the coin box 20 and the plate 22 carrying the insert slots 24 and the coin return ports 26 are made of heavier stock than the rest of the case 12 to make more difficult access to the coin box 20 by forced removal of the plate 22 carrying the slots or removal of the coin box 20 itself. A raised rib 28 extends around the periphery of the plate 22. One purpose for the rib is to reinforce the plate 22 to increase the difficulty of its removal by prying it away from the case 12 of the machine 10.

In coin operated machines, a coin box passage (not shown) communicates between the coin insert slots 24 and the coin box 20 for conveying coins from the insert slot to the coin box. A coin return passage leads from the coin box passage at point before the coin box passage reaches the coin box 20. The coin return passage is normally closed to the coin box passage by a flap (not shown) or similar closure device which can be moved to allow communication with the coin box passage when the coin return button is depressed so that the inserted coin is diverted into the coin return passage and to the coin return slot rather than to the coin box 20. An activation switch (not shown) is located in the coin passage near the opening of the coin return passage for placing the machine 10 in an operational mode upon sensing the passage of the appropriate coin or number of coins. As is normal with coin operated machines, the switch can be reached through the coin return passage if the flap can be opened to provide communication into the coin box passage. This can be accomplished in most coin operated machines by projecting a coin through one of the coin return ports 26 with sufficient force to open the flap so that the coin reaches the switch in the coin box passage to activate the switch causing the machine 10 to become operable. Activating the switch in this fashion is referred to as "coin flipping" and it is a common practice to activate the switch in this manner to enable one to operate the machine 10 free of charge. Referring to FIG. 1, the device of the invention comprises a closure 30 which is adapted to overlie the coin box 20 and the coin return ports 26. The closure 30 is attached to the case 12 of the machine 10 by permanent means such as by welded hinge plates 32 carrying eyes 34 to which the closure 30 is hingedly attached by aligning corresponding eyes 36 on the closure 30 and inserting a hinge rod 38 through the aligned eyes.

In FIG. 1 the closure 30 is shown in the open position for full access to the coin box 20 and the coin slots 24 and coin return ports 26, such as for servicing the machine 10 or retrieving the coins from the coin box 20.

In the secured position (FIGS. 2 and 3) the closure 30 is positioned over the insert slots 24, the coin return ports 26 and the coin box 20 and the closure 30 is secured to the case 12 of the machine 10 by a lock 40. The closure 30 is configured so that its periphery is contiguous with the outer edge of the raised rib 28. Thus any space between the closure and the case 12 is filled by the rib 28 to prevent the insertion of a prying tool, such as a pry bar or a screwdriver.

Figure 2:
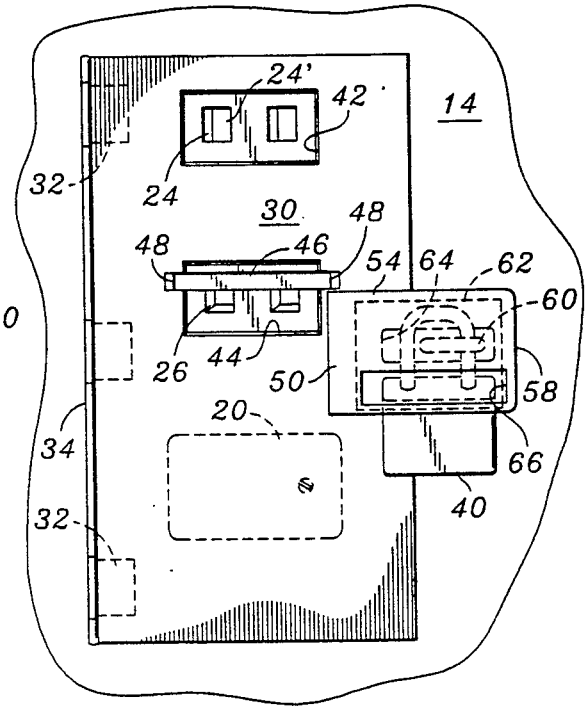
FIG. 2 is a front view in enlarged scale of the security ,; device of FIG. 1 in its locked securing position.
Figure 3:
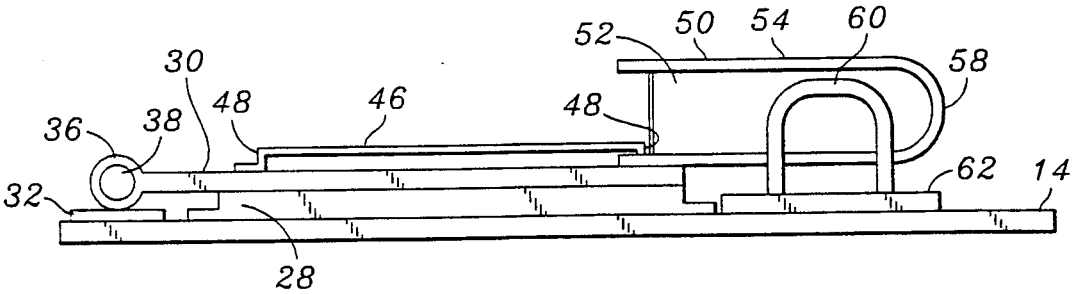
FIG. 3 is a bottom view of the security device of FIG. 2.

As illustrated in FIGS. 2 and 3, the closure 30 is provided with a first opening 42 for access to the coin insert slots 24 and a second opening 44 for access to the coin return ports 26. Access to the coin return ports 26 is limited by a strap 46 which is welded to the closure 30 and which extends across the second opening 44 to partially cover it. As is most clearly shown in FIG. 3, the strap 46 is offset from the plane of the front face of the closure 30 by forming perpendicular portions at each end to define legs 48. In addition the strap 46 is positioned on the closure 30 over the second opening 44 to overlie approximately the upper half of the coin return ports 26. In this position it is very difficult, if not impossible, to insert a finger into one of the coin return ports 26 and to propel a coin with sufficient force to open the flap and contact the activation switch to put the machine in an operational mode. However, in this position, the strap 46 does not interfere with retrieval of coins from the coin return ports 26.

A lock cover 50 having an interior defined by a top wall 52, a front wall 54, a rear wall 56 and a side wall 58 is welded to the free edge portion of the closure 30 and overlies the staple 60 carried by a base 62 which is secured to the case 12 by welding or by rivets. The lock cover 50 is open at a side facing the closure 30 and at its bottom. An opening 64 in the rear wall 56 is provided to permit the staple 60 to extend into the interior of the lock cover 50. When the closure 30 is in the secured position, access to the interior for inserting the shackle of the lock 40 through the staple 60 is through the open side and bottom of the lock cover 50. The lock cover 50 makes it very difficult to remove the lock to open the closure 30 by sawing the shackle or otherwise forcing the lock 40 open. Preferably, a round lock is used to secure the closure 30 so that the entire body of the lock 40 is contained within the interior of the lock cover 50. A key opening 66 is provided in the front wall for insertion of a key to unlock the lock 40.

Figure 4:
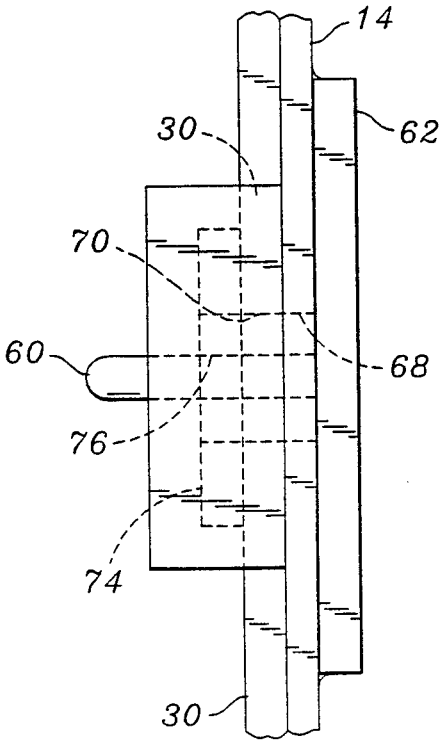
FIG. 4 is a side view, broken away for compactness of illustration, showing another way of securing the device of the invention.
Figure 5:
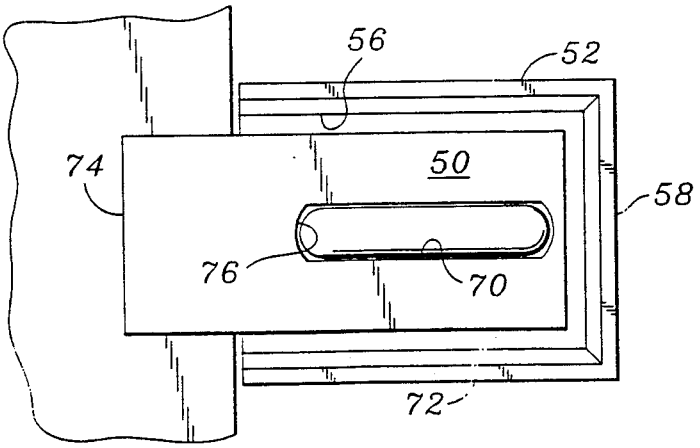
FIG. 5 is a front elevation of another embodiment of the lock cover of FIG. 4.

As shown in FIGS. 4 and 5, where like reference numbers denote like parts, the staple 60 is mounted on the case 12 by affixing the base 62 on the rear of the front face 14. The staple 60 extends through aligned slots 68 and 70 in the front face 14 and the lock cover 50 respectively. The lock cover 50 is modified as shown in removing the front wall 54 and includes the top wall 52, the rear wall 56, the side wall 58 and a bottom wall 72 which define the interior of the lock cover. The lock cover 50 is mounted on the front face 14 with the open side abutting the edge of the plate 22. A hasp 74 carried by the closure 30 and is received in the interior of the lock cover 50 when the closure 30 is in the secured position. A slot 76 in the hasp 74 is aligned with the slot 70 for the passage therethrough of the staple 60. In this manner access to the staple 60 and the hasp 74 is blocked by the lock cover 50 making it difficult to remove the hasp or the staple by prying or cutting.

In the case of coin operated machines that are not provided with a peripheral raised rib 28 of the type described above, the raised rib 28 can be formed on the inner face of the closure 30 about its periphery. The top edge of the raised rib is contiguous with the surface of the case 12 when the closure 30 is in the secured position and it functions in the same manner as described above for the peripheral raised rib 28 formed on the case 12 to make it more difficult to pry the closure 30 open.

Figure 6:
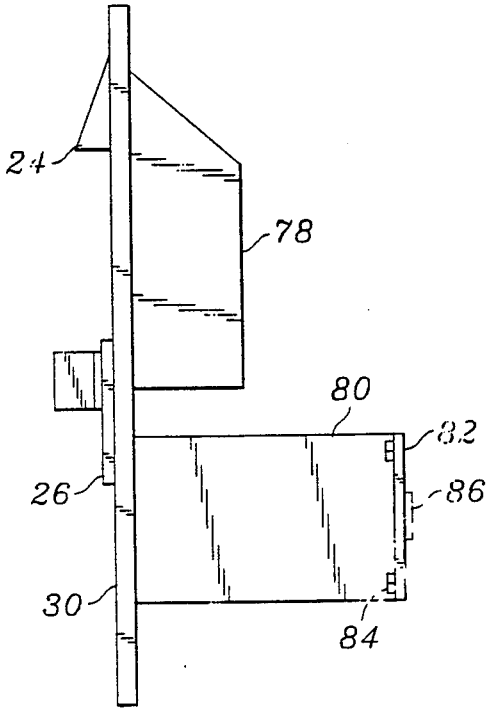
FIG. 6 illustrates another embodiment of the invention having the coin return mechanism and coin box affixed to the security device itself.

In the embodiments of the invention described thus far the coin return mechanism and the coin box are separate from the security closure. However, it will be understood that in the event thieves were able to penetrate to the interior of the case, access to the coin box can be made more difficult by the embodiment of the invention in which the coin return mechanism and the coin box are formed as part of the security closure so that access to the coin box is denied even should the case of the machine be penetrated. As shown in FIG. 6, a coin return mechanism 78 and coin box 80 are secured on the inner surface of the closure 30 which is hingedly affixed to the case 12 as described in FIG. 2. The coin return mechanism 78 and coin box 80 are preferably formed of the same stock as the closure 30 and welded to the inner surface of the closure. The coin return mechanism 78 is electrically connected by leads (not shown) to circuitry in the machine 10 for initiating operation of the machine in the manner conventional with such machines and generally described above. Access to the coin insert slots 24 and the coin return ports 26 provided by the first opening 42 and the second opening 44 the closure 30 as described in FIG. 2. The strap 46 provided to prevent coin flipping as described above. Access to the interior of the coin box 80, which is located in the interior of the case 12 when the closure 30 is in the closed, securing position, is through a rear door 82 which is attached to a side wall of the coin box by hinges 84. The door 82 is secured by a lock 86 which is only accessible when the closure is open.

Although the composition of the closure 30 and its components is not critical it will be apparent that the closure 30 must be formed of a material having good impact resistance and toughness to withstand attempts to force entry into the coin box of a coin operated machine. Preferably the closure 30 is formed of case hardened steel plate of sufficient thickness to resist cutting and bending, even where a pry tool is employed. Good results have been achieved where the closure 30 is formed from 3/16 inch case hardened 1018 steel plate. It will be understood that lighter materials can be employed where weight is a factor. In such a case thinner stock steel plate into which reinforcing ribs have been formed may be used. Also certain aluminum alloys and high strength plastic compositions may be used to form the closure 30.

As will be understood by those skilled in the art, various arrangements which lie within the spirit and scope of the invention other than those described in detail in the specification will occur to those persons skilled in the art. It is therefore to be understood that the invention is to be limited only by the claims appended hereto.

Having described the invention I claim:

1. A security device for coin operated machines having a hollow case, a coin box contained in said case, means in a surface of said case for access to said coin box and at least one coin return port opening to the exterior of said surface adjacent to said access means, said device comprising a closure having an outer face and an inner face, said closure being affixed to said case in a secured position overlying said access means and said coin return port and being movable therefrom to an open position to fully expose said access means to said coin box, means extending between the periphery of said closure and said surface of said case to provide contiguity therebetween when said closure is in the secured position, an opening in said closure aligned with said coin return port when said closure is in the secured position, a strap extending across said opening to partially cover said opening, said strap lying in a plane offset from the plane of said outer face of said closure to prevent manipulation of said machine through said coin return port but allowing access to said coin return port for retrieving coins therefrom.

2. The security device of claim 1 wherein said closure further includes a lock cover having an interior defined by a top wall, a front wall, a rear wall and a side wall for receiving and enclosing a staple affixed to said case and at least the shackle of a lock for locking said closure to said case when said closure is in the secured position.

3. The security device of claim 1 wherein said closure further includes a hasp through which extends a staple affixed to said case, a lock cover secured to said case having a top wall, a rear wall, a bottom wall and a side wall defining an interior for receiving and enclosing said hasp when said closure is in the secured position.

4. The security device of claim 1 wherein said means extending between the periphery of said closure and said surface of said case consists of a raised rib said raised rib surrounding said access means to said coin box and said return port, said rib being disposed between the periphery of said closure and said case when said closure is in the secured position.

5. The security device of claim 4 wherein said raised rib is formed on said case.

6. The security device of claim 4 wherein said raised rib is formed on the periphery of said inner face of said closure.

7. The security device of claim 1 wherein said closure is fixed to said case by means of hinges permanently attached to said case for movement between said secured position and said open position.

8. A security device for coin operated machines having a 11ow case including a front face and an access opening to the interior of said machine, a coin box normally contained in said case, a coin return mechanism normally contained in said case, said device comprising a closure having an outer face box secured to said inner face of said closure, at least one coin return port opening to the exterior of said closure and communicating with said coin return mechanism, said closure being hingedly affixed to said case for movement between a secured position overlying said access opening and an open position to fully expose said coin return mechanism and said coin box, a strap extending across said coin return port to partially cover said port, said strap lying in a plane offset from the plane of said outer face of said closure to prevent manipulation of said machine through said coin return port but allowing access to said coin return port for retrieving coins therefrom.

* * * * *